US007089686B2

(12) United States Patent
Lange et al.

(10) Patent No.: US 7,089,686 B2
(45) Date of Patent: Aug. 15, 2006

(54) APPARATUS FOR CURING RADIATION-CURABLE COATINGS

(75) Inventors: Herbert Lange, Obergriesbach (DE); Hartmut Krannich, Obergriesbach (DE); Reiner Mehnert, Markkleeberg (DE); Axel Sobottka, Leipzig (DE)

(73) Assignee: Cetelon Lackfabrik Walter Stier GmbH & Co. KG, (DE)

( * ) Notice: Subject to any disclaimer, the term of this patent is extended or adjusted under 35 U.S.C. 154(b) by 0 days.

(21) Appl. No.: 10/662,887

(22) Filed: Sep. 15, 2003

(65) Prior Publication Data

US 2004/0111914 A1 Jun. 17, 2004

(30) Foreign Application Priority Data

Sep. 13, 2002 (DE) ..... 102 42 719

(51) Int. Cl.
*F26B 3/34* (2006.01)

(52) U.S. Cl. ..... 34/278

(58) Field of Classification Search ..... 34/275, 34/278; 250/494; 427/504, 522
See application file for complete search history.

(56) References Cited

U.S. PATENT DOCUMENTS

| | | | | |
|---|---|---|---|---|
| 3,767,457 | A | 10/1973 | Hubbard, Jr. et al. | |
| 4,095,113 | A | 6/1978 | Wolff | |
| 4,143,278 | A * | 3/1979 | Koch, II | 422/186.3 |
| 4,490,410 | A | 12/1984 | Takiyama et al. | |
| 5,387,801 | A | 2/1995 | Gonzalez et al. | |
| 5,486,384 | A | 1/1996 | Bastian et al. | |
| 5,634,402 | A * | 6/1997 | Rudd et al. | 101/424.1 |
| 5,655,312 | A * | 8/1997 | Sevcik | 34/275 |
| 5,901,462 | A * | 5/1999 | Rudd | 34/274 |
| 5,914,074 | A * | 6/1999 | Martin et al. | 264/1.38 |
| 6,185,840 | B1 | 2/2001 | Noelle et al. | |

FOREIGN PATENT DOCUMENTS

| | | |
|---|---|---|
| DE | 29605835 | 7/1997 |
| DE | 19611763 | 10/1997 |
| DE | 19810201 | 9/1999 |
| DE | 19957900 A1 | 6/2001 |
| EP | 0 540 884 A1 | 5/1993 |
| EP | 0 559 500 A1 | 9/1993 |
| EP | 0559500 A1 | 9/1993 |
| FR | 2598921 | 11/1987 |
| WO | WO 96/34700 | 11/1996 |
| WO | WO 01/39897 A2 | 6/2001 |

OTHER PUBLICATIONS

Copy of European Search Report dated Nov. 21, 2003, from European Patent Appln. No. EP03020307 (the European counterpart to the subject application).

* cited by examiner

*Primary Examiner*—S. Gravini
(74) *Attorney, Agent, or Firm*—Kriegsman & Kriegsman

(57) ABSTRACT

The present invention relates to an apparatus (20, 30) for curing radiation-curable coatings, which has at least one irradiation chamber (22, 32) provided with a plurality of UV radiation sources (18). It is provided according to the invention that a plurality of UV radiation sources (18) are arranged close to one another and interconnected to form one or more irradiation modules (10), the illuminance inside a irradiation module (10) and/or between at least two irradiation modules (10) being spatially variable.

10 Claims, 4 Drawing Sheets

APPARATUS FOR CURING RADIATION-CURABLE COATINGS

DESCRIPTION

The present invention relates to an apparatus for curing radiation-curable coatings, which has at least one irradiation chamber provided with a plurality of UV radiation sources, in particular of planar or three-dimensional substrates provided with such coatings.

It is known to cure radiation-curable coatings by means of high-energy UV radiation, for example by using medium-pressure mercury radiators or UV Excimer radiators (R. Mehnert et al., UV & EB Technology and Application, SITA-Valley, London 1998). The specific electric power of these radiators is typically between 50 and 240 W per cm radiator length. For a radiator length of 1 m, the converted electric power is thus between 5 and 24 kW. These powerful radiators are used chiefly for curing coatings on planar substrates. Typical illuminances of 100 to 1000 mW/cm$^2$ are measured on the layer to be cured. It is possible thereby to achieve curing times of 100 ms and less. Such a system is known, from DE 24 25 217 A1.

An apparatus of the generic type is also known, for example, from WO 96/34700 A1 and FR 2 230 831 A1.

It is to be borne in mind when applying medium-pressure mercury radiators that approximately 50% of the electric power is converted into heat. An arrangement in which radiators of this type are situated close to one another fails not only for reasons of overheating, but also because of the high-voltage supply required at the ends (electrodes) of the radiators.

Admittedly, in the case of UV Excimer radiators the heat is dissipated by cooling the lamp surface, but the distance between neighboring tubes and their geometric arrangement is likewise limited by the required high-voltage supply.

Because of the biological effects of UV rays, extensive screening measures and other protective measures are required when use is made of these UV radiators. In order to cure coatings on three-dimensional objects, individual UV radiators are, for example, fitted in closed spaces such that it is possible to ensure adequate radiation protection. An adequate homogeneous irradiation of the coatings to be cured on three-dimensional substrates is, however, impossible in practice. The energy outlay for curing is therefore determined by the outlay for curing layer regions, that can be achieved only by obliquely incident radiation or scattered radiation.

It is therefore the object of the present invention to make available an apparatus of the generic type that is suitable for treating both planar and three-dimensional substrates, and in the case of which the energy outlay can be reduced and it is possible to dispense with complicated measures for protection against radiation and heat.

The solution consists in that a plurality of UV radiation sources are arranged close to one another and interconnected to form one or more irradiation modules, the illuminance inside an irradiation module and/or between at least two irradiation modules being spatially variable.

Thus, it is provided according to the invention that the apparatus is constructed from geometrically suitable arrangements of a plurality of closely juxtaposed radiation sources. Each of these arrangements is denoted as an irradiation module. Thus, an irradiation module is understood here as a planar arrangement of radiation sources arranged close next to one another (for example with a common electric supply). The enveloping surface of the radiation sources of each module can be flat or curved. It is possible to construct irradiation modules that focus light into a selected, including curved, irradiation plane, and which permit the substrate surfaces to be irradiated in a geometrically largely homogeneous fashion.

The construction is therefore performed in such a way that a spatially variable illuminance is set up in the interior of the irradiation chamber, in which the radiation-curable coatings are cured, such that the coating to be cured is cured homogeneously without there being a disturbing input of heat into the coating and/or substrate. The variation can be performed, on the one hand, by setting the enveloping surfaces of the radiation sources of a single module and, on the other hand, by the spatial arrangement of the irradiation modules relative to one another in the apparatus, it being possible to realize a multiplicity of geometric arrangements. Owing to the modular construction, the apparatus can thus be adapted to the geometry of the substrate to be treated such that the energy outlay is reduced. This has the consequence, furthermore, that it is possible to simplify, that is to say limit the radiation protection, for example to measures such as are valid for the use of tanning lamps.

Advantageous developments follow from the subclaims. As radiation sources, consideration is given to lamps, preferably fluorescent tubes, of low electric power, for example from 0.1 to 10 W per cm radiator length, which have, for example, a continuous emission spectrum between 200 and 450 nm, preferably between 300 and 450 nm. Since the development of heat is lower than in the case of high-power UV radiators, it is sufficient to cool merely the surface thereof, for example with the aid of an air current.

Such lamps are known per se and are used, for example, as tanning lamps in solaria. With a specific power of, for example, 1 W per cm radiator length and the low illuminance resulting therefrom, these lamps are not suitable as such for technical applications for curing radiation-curable coatings. Such lamps, which are typically provided with reflectors with emission angles of, for example, approximately 160°, generally have standardized dimensions (diameter of the tubes approximately 25 to 45 cm, luminance length up to approximately 200 cm) and are operated at an operating voltage of 220 V, are very well suited as radiation sources for the irradiation modules mentioned. This relates, in particular, to the reflectors that simplify focusing into the desired irradiation plane. Also advantageous is their high photon yield of approximately 30% of the electric power.

At a distance of, for example, 10 cm from the radiation source, irradiation modules of this design yield illuminances of typically approximately 20 mW/cm$^2$. Admittedly, these illuminances are smaller by a factor of 5 to 50 than those that can be achieved with conventional UV radiators, but they suffice to cure coatings given radiation times of approximately 30 to 300 s.

A further advantageous development consists in that at least one irradiation module is arranged in the apparatus in a fashion capable of movement about at least one of its three spatial axes. This facilitates the geometric adaptation to the substrate and the focusing of the rays in the desired radiation plane.

In order to improve the adhesion of radiation-cured coatings on some substrates such as, for example, polypropylene, polycarbonate and polyamide, it is advantageous also to vary the illuminance temporally. If the irradiation is begun, with a low illuminance, the layer, which is always shrinking during curing, can relax more effectively than in the case of immediate irradiation with a high illuminance. Stresses between the layer to be cured and the substrate can be balanced out more effectively. The consequence is a better adhesion of the cured layer on the substrate. A temporal control of the power of the individual irradiation modules is possible in a simple way, and so it is possible to exploit this advantageous irradiation regime.

Illuminances that are achieved by interconnecting suitable radiation sources to form irradiation modules are sufficient for curing the radiation-curing coating whenever the curing is performed under an inert protective gas such as, for example, nitrogen. Conducting radiation curing under protective gas is known per se and described, for example, in DE 199 57 900A1, EP 540 884 A1, and in the publications mentioned above.

Exemplary embodiments of the present invention are explained in more detail below with the aid of the attached drawings, in which:

FIG. 1*a*: shows a schematic illustration, not true to scale, of an embodiment of the irradiation module in the view from below;

FIG. 1*b*: shows the irradiation module from FIG. 1*a* in a side view in accordance with arrow B;

FIG. 1*c* shows the irradiation module from FIG. 1*a* in a side view in accordance with arrow C;

Figures 1A, 1B, 1C:
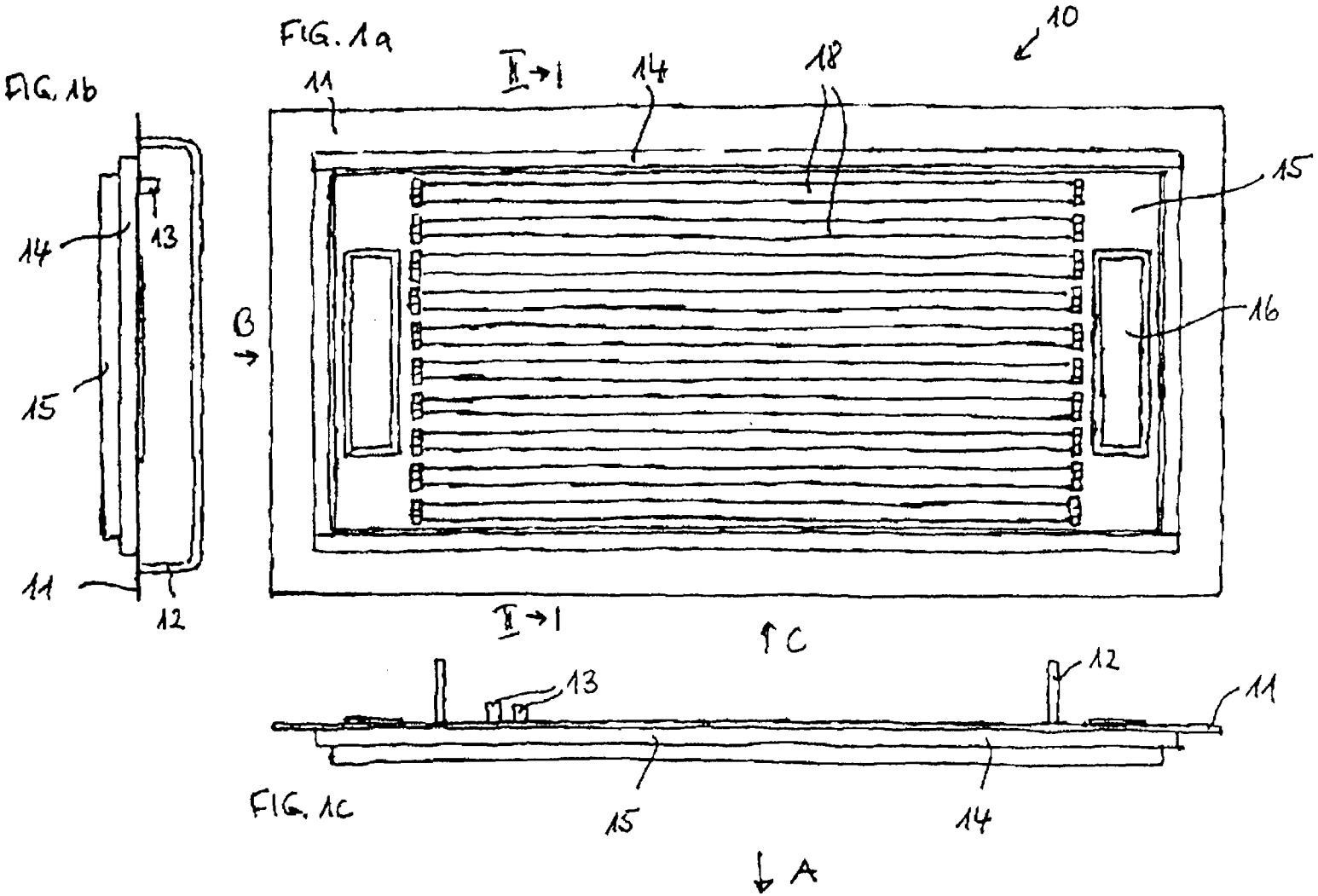
Figure 2:
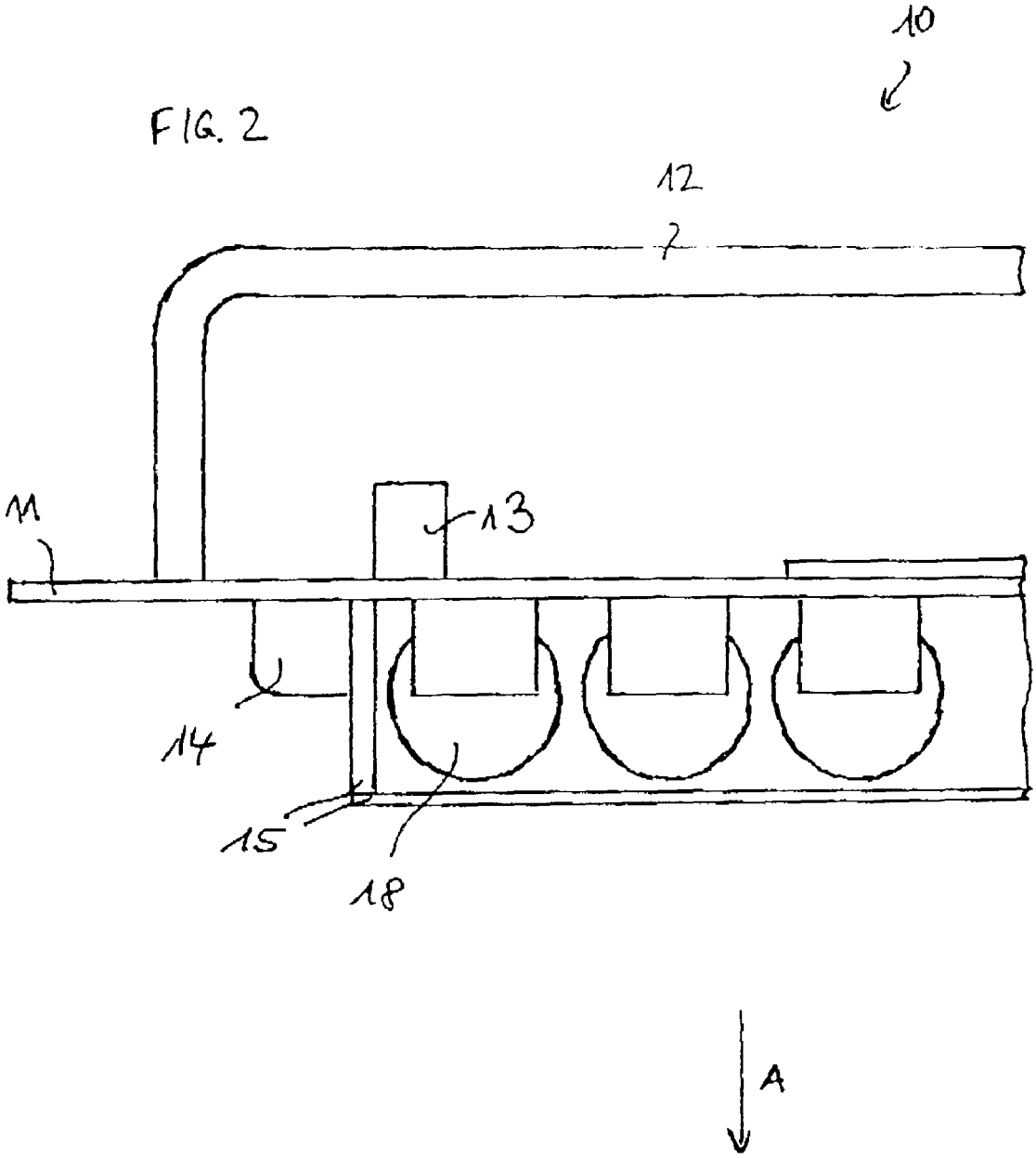
FIG. 2 shows a section along the line II—II in FIG. 1*a;*

The structure of the irradiation module 10 according to the invention immerges in exemplary fashion from the exemplary embodiment illustrated in FIGS. 1 and 2.

The components are mounted on a baseplate 11. The baseplate 11 preferably consists of a metal such as aluminum or steel, or of a metal alloy, and has on its rear side the required electric terminals 13 and, if appropriate, a holder 12. Furthermore, devices can be provided there for installing the irradiation module 10 in irradiation systems and devices for moving the irradiation module 10. Also mounted on the baseplate are the starters and terminals for UV radiation sources 18. Inlet and outlet for a ventilation system 16 of the radiation sources 18 are also located here. Cross-flow fans, for example, are suitable for this purpose.

Also provided on the front side of the baseplate 11 is a frame 14 inside which the ventilation system 16 and the UV radiation sources 18 are installed. Suitable UV radiation sources 18 are, for example, fluorescent tubes such as are used as tanning lamps in solaria. Such fluorescent tubes generally have standardized dimensions, for example a luminance length of 2 m in conjunction with a diameter of 25 to 45 cm. They can, furthermore, be provided with reflectors that have an emission angle of approximately 160°, for example. These fluorescent tubes are operated at an operating voltage of 220 V.

The frame 14 with the ventilation system 16 and the UV radiation sources 18 is surrounded on three sides in an airtight fashion by a UV-transparent plate 15, for example made from plastic, such as, for example, polymethylmethacrylate or polycarbonate. The surface of the plate 15 forms the front side of the irradiation module 10, as illustrated by the arrow A symbolizing the direction of radiation.

One or more irradiation modules 10 are installed in a sealed radiation vessel. The radiation vessel surrounds an irradiation space that is illuminated by at least one irradiation module.

Figure 3:
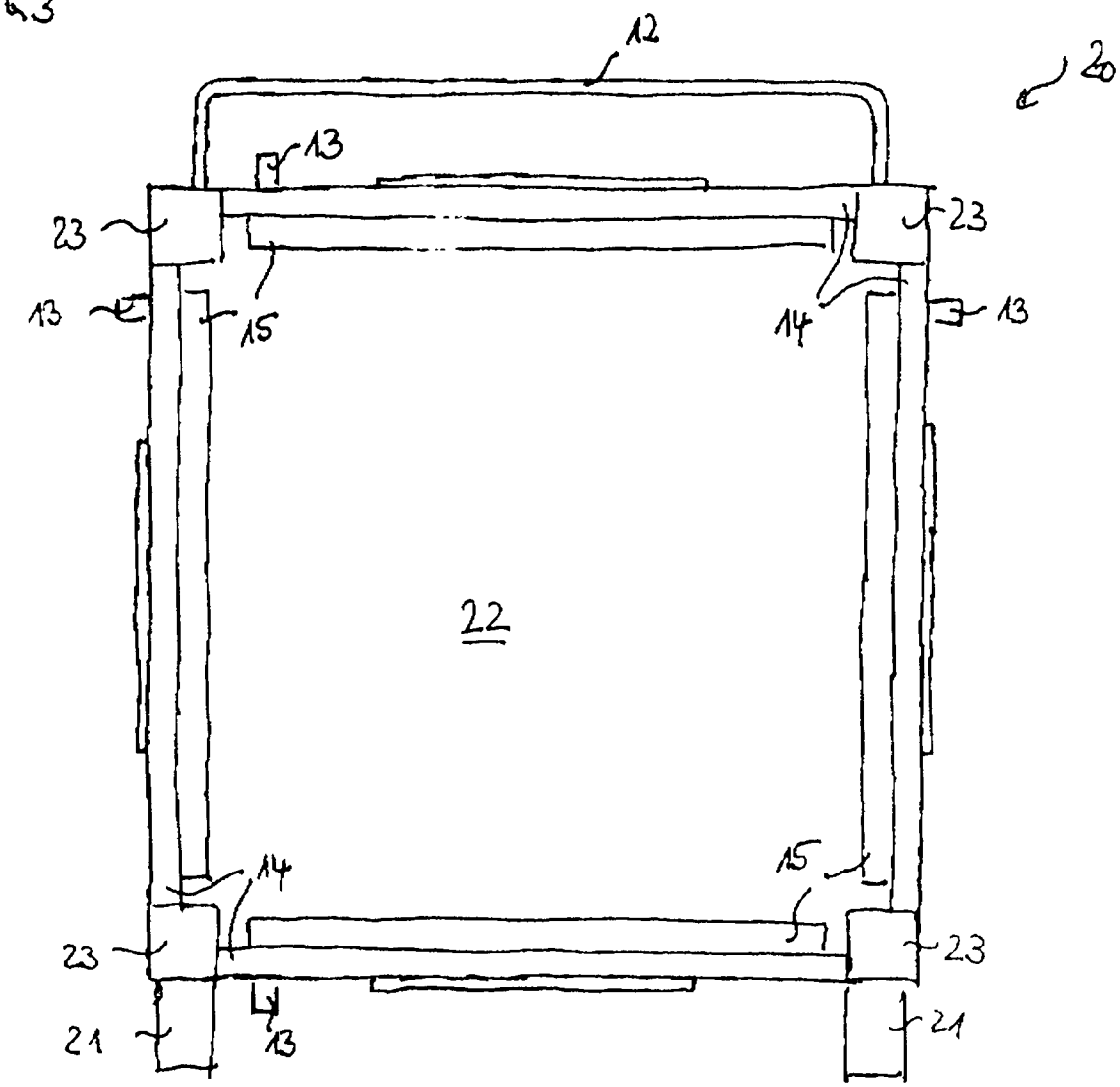
FIG. 3 shows a schematic side view, not true to scale, of an exemplary embodiment of the apparatus according to the invention for discontinuous irradiation.

FIG. 3 shows schematically an exemplary embodiment of an apparatus 10 according to the invention for discontinuous irradiation of substrates. A rectangular container, provided with supporting feet 21, of length 2.10 m, width 80 cm and height 80 cm was equipped with four irradiation modules 10 of length 1.50 m and equipped with 10 fluorescent tubes 18 arranged in a planar fashion. The irradiation modules 10 were fastened at the frame of the container on the base, the sides and the cover. The upper irradiation module can be raised with the cover of the container. The fluorescent tubes 18 in the irradiation modules 10 were cooled by means of cross-flow fans.

The upper sides of the plates 15 of the irradiation modules define and surround a rectangular irradiation space 22 of length 1.60 m, width 60 cm and height 40 cm. Furthermore, four laterally arranged tubes 23 each having 40 bores for letting in nitrogen are located in the irradiation space 22.

Such a device 20 can be operated as follows. The coated substrates are introduced into the irradiation space 22. Thereafter, the irradiation space 22 is flooded with inert gas. When an oxygen concentration of 5%, preferably 1%, with particular preference 1%, is reached, the irradiation is started, and it is terminated after curing of the layer. The duration of the irradiation is typically approximately 30 to 300 s. In this embodiment, the apparatus according to the invention is particularly suitable for curing coatings on molded parts. It renders possible the application of radiation curing, for example in the hand icraft sector for production and repair. The moderate electric supply power of the modules, which is typically 1 to 2 kW, is advantageous in this case.

Figure 4:
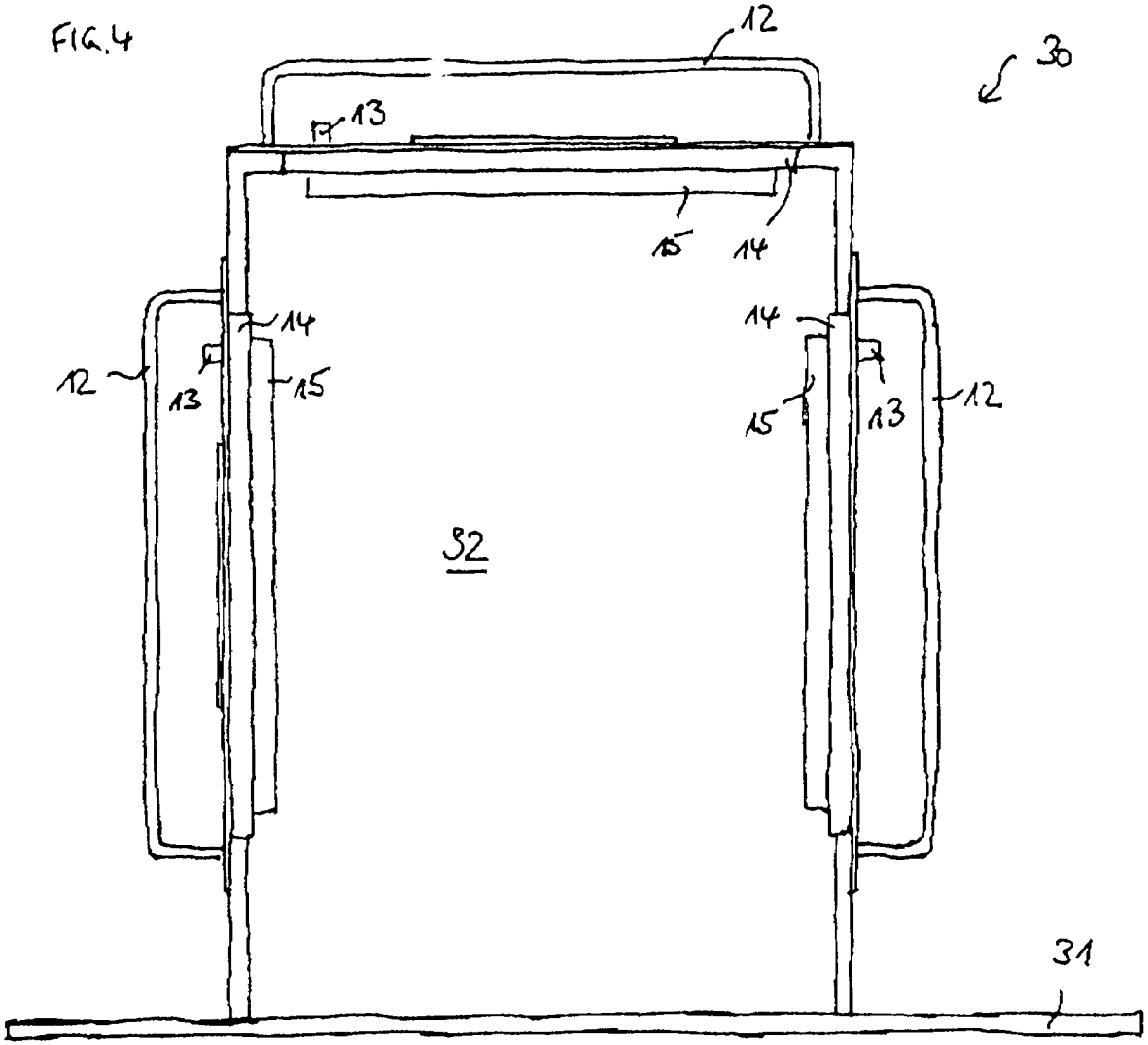
FIG. 4 shows a schematic side view, not true to scale, of an exemplary embodiment of the apparatus according to the invention for continuous irradiation.

In a test, a motor vehicle rim as molded part was coated on all sides with a radiation-curing spray lacquer. The rim was provided with a holder at the valve hole and suspended in the irradiation space 22. After closure of the irradiation space 22, the latter was flooded with nitrogen. The concentration of the oxygen was measured with the aid of a sensor in the irradiation space 22, and displayed. An oxygen concentration of below 0.1% was achieved after flooding for 2 minutes given a nitrogen current of 60 $m^3$/h. Once this value was reached, the nitrogen current was reduced to 10 $m^3$/h and irradiation was started. After an irradiation time of 2 minutes, the nitrogen was switched off and the apparatus 20 was opened. The lacquer on the rim was cured at all points and could also not be damaged by manual pressure. However, the irradiation modules 10 described can also be used to construct and irradiation tunnel 30 as it is illustrated diagrammatically in FIG. 4. In such an irradiation tunnel 30, the irradiation modules 10 are arranged on the sides and on the top side such that they define and surround a tunnel-shaped irradiation space 32. Coated substrates passing through via conveying appliances, for example, can be cured therein during the traverse. If, for example, two irradiation modules are arranged in a row, the luminance length of the irradiation space 32 can be up to 4 m. If the curing is performed within approximately 30 to 300 s, transit speeds of 0.8 to 8 m/min are possible. It is to be borne in mind in this case that the residual oxygen concentration should be sufficiently low during the transit and the irradiation. The atmospheric oxygen introduced into the irradiation zone by the movement of the molded part to be irradiated should not exceed the limiting value of 5%. Consequently, locks and/or suitable nozzles are advantageously provided, chiefly upstream of the irradiation zone, as seen in the conveying direction, for the purpose of feeding in inert gas, preferably nitrogen, which prevents the entrainment of air.

The invention claimed is:

1. An apparatus for curing radiation-curable coatings, said apparatus comprising at least two irradiation modules defining at least one irradiation chamber, each irradiation module comprising a baseplate, a plurality of UV radiation sources mounted on said baseplate and a UV-transparent plate mounted on said baseplate in such a manner that said UV-transparent plate surrounds said UV radiation sources on three sides in an airtight fashion, the illuminance inside an irradiation module and/or between at least two irradiation modules being spatially variable in such a way that at least one irradiation module is capable of movement about at least one of its axes.

2. The apparatus as claimed in claim 1, wherein lamps are provided as UV radiation sources.

3. The apparatus as claimed in claim 1, wherein the UV radiation sources have a continuous emission spectrum between 200 and 450 nm.

4. The apparatus as claimed in claim 2 or 3, wherein a ventilation system is provided for cooling the surface of the UV radiation sources.

5. The apparatus as claimed in claim 1, wherein at least a plurality of radiation sources have reflectors.

6. The apparatus as claimed in claim 1, wherein the illuminance of at least one irradiation module can be set in the temporally variable fashion.

7. The apparatus as claimed in claim 2, wherein the lamps are fluorescent tubes with a power of 0.1 to 10 W per cm radiator length.

8. The apparatus as claimed in claim 2, wherein the lamps are fluorescent tubes with a power of 1 W per cm radiator length.

9. The apparatus as claimed in claim 3, wherein the UV radiation sources have a continuous emission spectrum between 300 and 450 nm.

10. The apparatus as claimed in claim 1, wherein at least a plurality of radiation sources have reflectors with emission angles of 160°.

* * * * *